US007299999B2

(12) United States Patent
Walker

(10) Patent No.: US 7,299,999 B2
(45) Date of Patent: Nov. 27, 2007

(54) ROTATING STREAM SPRINKLER WITH TORQUE BALANCED REACTION DRIVE

(75) Inventor: Samuel C. Walker, Upland, CA (US)

(73) Assignee: Rain Bird Corporation, Glendora, CA (US)

( * ) Notice: Subject to any disclaimer, the term of this patent is extended or adjusted under 35 U.S.C. 154(b) by 0 days.

(21) Appl. No.: 10/406,066

(22) Filed: Apr. 2, 2003

(65) Prior Publication Data

US 2004/0195362 A1 Oct. 7, 2004

(51) Int. Cl.
*B05B 3/06* (2006.01)

(52) U.S. Cl. ..... 239/252; 239/246; 239/256; 239/397

(58) Field of Classification Search ..... 239/246, 239/247, 251, 252, 256, 257, 258, 397
See application file for complete search history.

(56) References Cited

U.S. PATENT DOCUMENTS 1,704,610 A * 3/1929 Jaden ..... 239/252
1,798,709 A * 3/1931 Smith ..... 239/442
2,108,787 A 2/1938 Coles et al.
2,557,206 A * 6/1951 Spender ..... 239/246
3,038,667 A * 6/1962 Ridgway ..... 239/257
4,119,275 A 10/1978 Hunter
4,440,345 A 4/1984 Figwer et al.
4,498,626 A 2/1985 Pitchford
4,637,549 A 1/1987 Schwartzman
4,660,766 A 4/1987 Nelson et al.
4,687,139 A 8/1987 Lockwood
4,784,325 A 11/1988 Walker et al.
4,796,811 A 1/1989 Davisson
4,815,662 A 3/1989 Hunter
4,886,211 A 12/1989 Cohen
4,898,332 A 2/1990 Hunter et al.
4,932,590 A 6/1990 Hunter
4,971,250 A 11/1990 Hunter
4,986,474 A 1/1991 Schisler et al.
5,007,586 A 4/1991 Cohen
5,014,372 A 5/1991 Thrasher et al.
5,058,806 A 10/1991 Rupar
RE33,823 E 2/1992 Nelson et al.
5,148,990 A 9/1992 Kah, Jr.
5,224,653 A 7/1993 Nelson et al.
5,226,602 A 7/1993 Cochran et al.
5,288,022 A 2/1994 Sesser
5,372,307 A 12/1994 Sesser (Continued)

*Primary Examiner*—Christopher Kim
(74) *Attorney, Agent, or Firm*—Fitch, Even, Tabin & Flannery

(57) ABSTRACT

An improved rotating stream sprinkler of the type having a rotatable spray head with an offset nozzle port through which a water stream is projected outwardly, resulting in a reaction force for rotatably driving the spray head to sweep the water stream over a surrounding terrain area. The spray head is rotatably mounted on a body adapted for connection to a pressurized water supply, with interengaging bearing components providing predetermined friction brake torque resisting spray head rotation. By appropriately designing the nozzle port area and offset geometry, drive torque and brake torque is maintained at a substantially constant ratio for relatively slow and substantially constant spray head rotational speed over a range of normal water supply operating pressures. A downthrust spring retains the bearing components in engagement when the water supply is turned off, but does not contribute to friction brake torque when the water supply is turned on.

14 Claims, 5 Drawing Sheets

U.S. PATENT DOCUMENTS 5,377,914 A 1/1995 Christen
5,476,223 A 12/1995 Drechsel
5,556,036 A 9/1996 Chase
5,647,541 A 7/1997 Nelson
5,671,886 A 9/1997 Sesser
5,730,365 A 3/1998 Messinger
5,845,849 A 12/1998 Mitzlaff
5,909,848 A 6/1999 Zink
5,971,297 A 10/1999 Sesser
6,135,364 A 10/2000 Nickish
6,142,386 A 11/2000 Spenser
6,193,169 B1 2/2001 Steinhilber et al.

* cited by examiner

ROTATING STREAM SPRINKLER WITH TORQUE BALANCED REACTION DRIVE

BACKGROUND OF THE INVENTION

This invention relates generally to improvements in irrigation sprinklers of the type having a rotatable spray head driven by hydraulic reaction forces for sweeping an outwardly projected stream of water over a surrounding terrain area to irrigate adjacent vegetation. More specifically, this invention relates to an improved rotating stream sprinkler having a balanced drive torque and friction brake torque for maintaining a relatively slow and substantially constant spray head rotational speed over a range of normal water supply operating pressures.

Rotating stream sprinklers of the reaction drive type are known in the art for use in sweeping an outwardly projected stream of irrigation water over surrounding terrain for landscape irrigation. In one common form, a spray head is rotatably mounted on a sprinkler body and includes a nozzle port having a selected open flow area and inclination angle for outward discharge of the irrigation water stream, when the sprinkler body is connected to a supply of water under pressure. The nozzle port is offset relative to an axis of spray head rotation, whereby the outwardly projected water stream produces a reaction force for continuously rotatably driving the spray head and thereby sweeping the water stream in a continuous or uninterrupted manner over the adjacent terrain. To accommodate such rotational displacement, bearing and related seal components are interposed between the rotatable spray head and the nonrotating sprinkler body.

In the past, such rotating stream sprinklers have suffered from relatively rapid and uncontrolled rotational speeds, resulting in an undesirably reduced range or radius of throw for the projected water stream. In this regard, rotational driving of the spray head at an excessive speed occurs when the hydraulic reaction drive torque significantly exceeds the counteracting brake torque attributable, for example, to frictional resistance forces provided by the bearing and related seal components.

Attempts to reduce and regulate the speed of spray head rotation by reducing the drive torque having resulted in inconsistent sprinkler operation, particularly in response to unexpectedly increased brake torque related to intrusion of dirt and grit between bearing surfaces. Indeed, such intrusion of dirt and grit into the bearing components can increase brake torque sufficiently to prevent spray head rotation when the water supply is turned on.

Conversely, efforts to reduce and control spray head rotational speed by increasing the brake torque during normal operation, as by applying a spring force to the bearing components, have also resulted in inconsistent sprinkler operation. In particular, a thrust spring has been employed for applying an axial spring force to the bearing components, with the intent to increase the friction brake torque and thereby decrease the drive/brake torque differential to slow down the speed of spray head rotation. However, during normal sprinkler operation, drive torque attributable to increasing water supply pressure has been found to increase at a rate which significantly exceeds friction brake torque attributable to the thrust spring, whereby the spray head rotation at relatively high water supply pressures may again be inconsistent and undesirably rapid.

The present invention overcomes these problems and disadvantages by providing torque balanced reaction drive wherein drive torque and brake torque are maintained in a substantially constant ratio throughout a normal operating range of low to high water supply pressures, thereby providing a relatively slow and substantially constant spray head rotational speed.

SUMMARY OF THE INVENTION

In accordance with the invention, an improved rotating stream sprinkler is provided of the type having a rotatable spray head with an offset nozzle port through which an irrigation water stream is projected outwardly, resulting in a reaction force for rotatably driving the spray head to sweep the water stream over a surrounding terrain area. The spray head is rotatably mounted on a sprinkler body adapted for connection to a supply of water under pressure, with interengaging bearing components providing a predetermined friction brake torque resisting spray head rotation. The nozzle port area and offset geometry are designed to provide a predetermined drive torque, whereby the drive torque and brake torque are maintained at a substantially constant ratio for relatively slow and substantially constant spray head rotational speed over a normal operating range of water supply pressures.

The rotating stream sprinkler comprises the spray head rotatably mounted on the sprinkler body and including a nozzle member having the nozzle port formed therein. The nozzle port has a selected open flow area in combination with a selected inclination angle, and is formed in the nozzle member for outward projection of the irrigation water stream in a direction that is offset by a selected radial increment to one side of a central axis of spray head rotation. As a result, the outwardly projected water stream produces a reaction force which acts on and rotatably drives the spray head, for correspondingly sweeping the projected water stream over the surrounding terrain to irrigate adjacent vegetation. The specific nozzle member may be selected from among a plurality of nozzle members having nozzle ports formed therein with different open flow areas and different radial offsets, with each nozzle member being designed to apply substantially the same reaction drive torque to the spray head during normal sprinkler operation.

The bearing components rotatably support the spray head on the sprinkler body, and are designed to provide a predetermined friction brake torque to resist spray head rotation during sprinkler operation. In one preferred form, the bearing components comprise at least one annular rotatable brake washer carried with the spray head for rotation therewith and retained in axial friction-bearing engagement with at least one annular stationary or static brake washer carried by the nonrotating sprinkler body. The materials selected for these interengaging brake washers, and the radial dimensions thereof, are selected to provide the predetermined brake torque during sprinkler operation.

A thrust spring retains the bearing components in axial bearing engagement when the water supply is turned off, and during relatively low pressure transient intervals as the water supply is turned on or off to initiate or conclude a sprinkler watering cycle. This thrust spring thereby prevents axial separation of the bearing components during these conditions to preclude ingress or intrusion of dirt or grit or other foreign matter that could otherwise undesirably alter the brake torque provided during normal sprinkler operation. When the water supply is turned on and the operating pressure increases to a normal operating range, the thrust spring is compressed sufficiently to permit a pair of spring flanges at opposite ends thereof to engage or bottom out against each other, thereby preventing the thrust spring from contributing to brake torque during normal sprinkler operation.

Other features and advantages of the present invention will become more apparent from the following detailed description taken in conjunction with the accompanying drawings which illustrate, by way of example, the principles of the invention.

BRIEF DESCRIPTION OF THE DRAWINGS

The accompanying drawings illustrate the invention. In such drawings:

FIG. 5 is a fragmented vertical sectional view similar to FIG. 4, but showing the sprinkler in an operating position with a water supply turned on.

DETAILED DESCRIPTION OF THE PREFERRED EMBODIMENT

Figure 1:
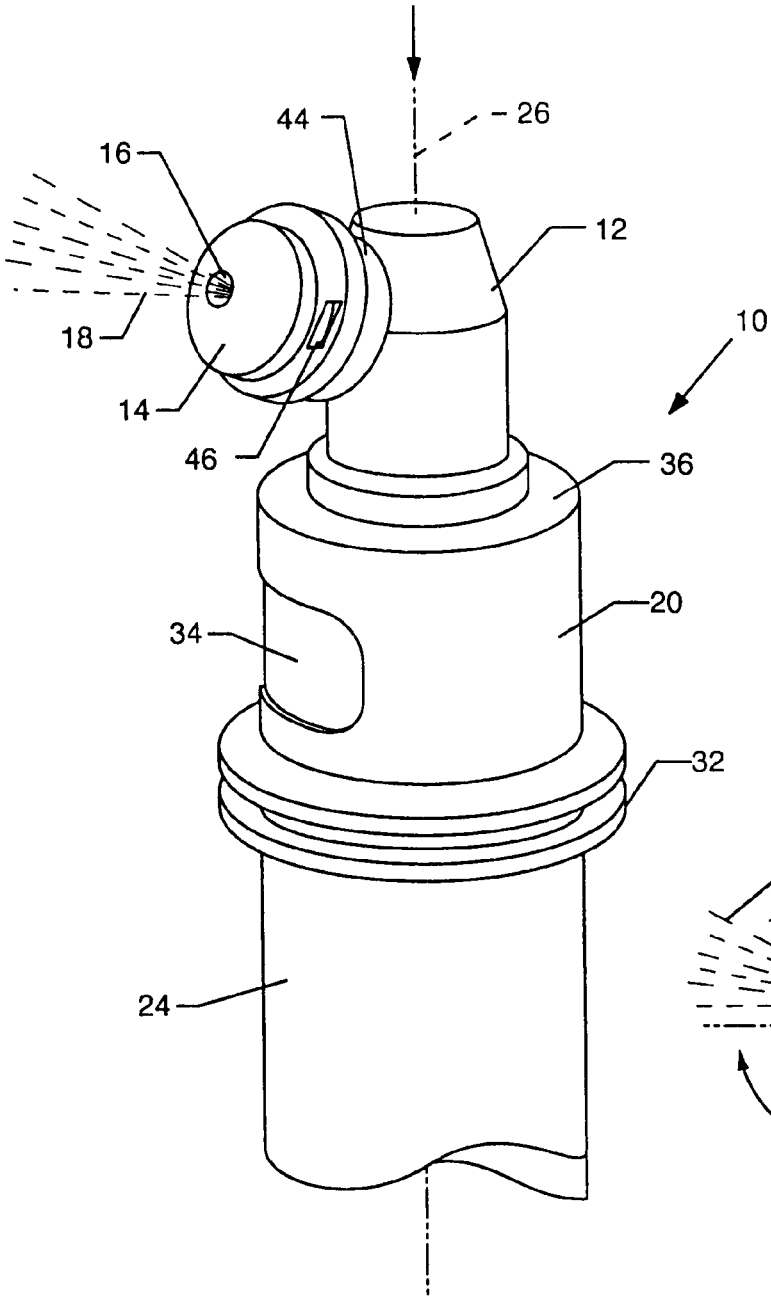
FIG. 1 is a fragmented perspective view illustrating a rotating stream sprinkler of the present invention shown installed onto the upper end of a tubular riser.
Figure 2:
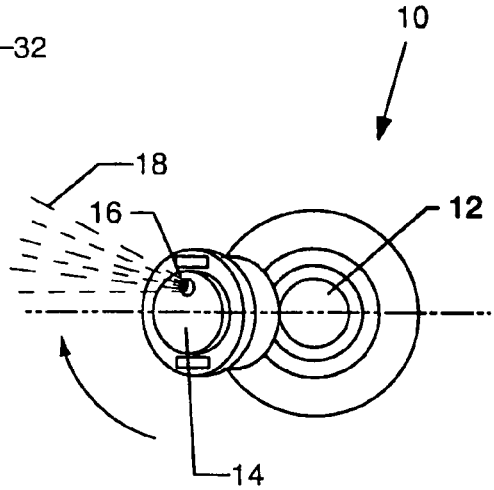
FIG. 2 is a top plan view of the rotating stream sprinkler viewed in FIG. 1.
Figure 3:
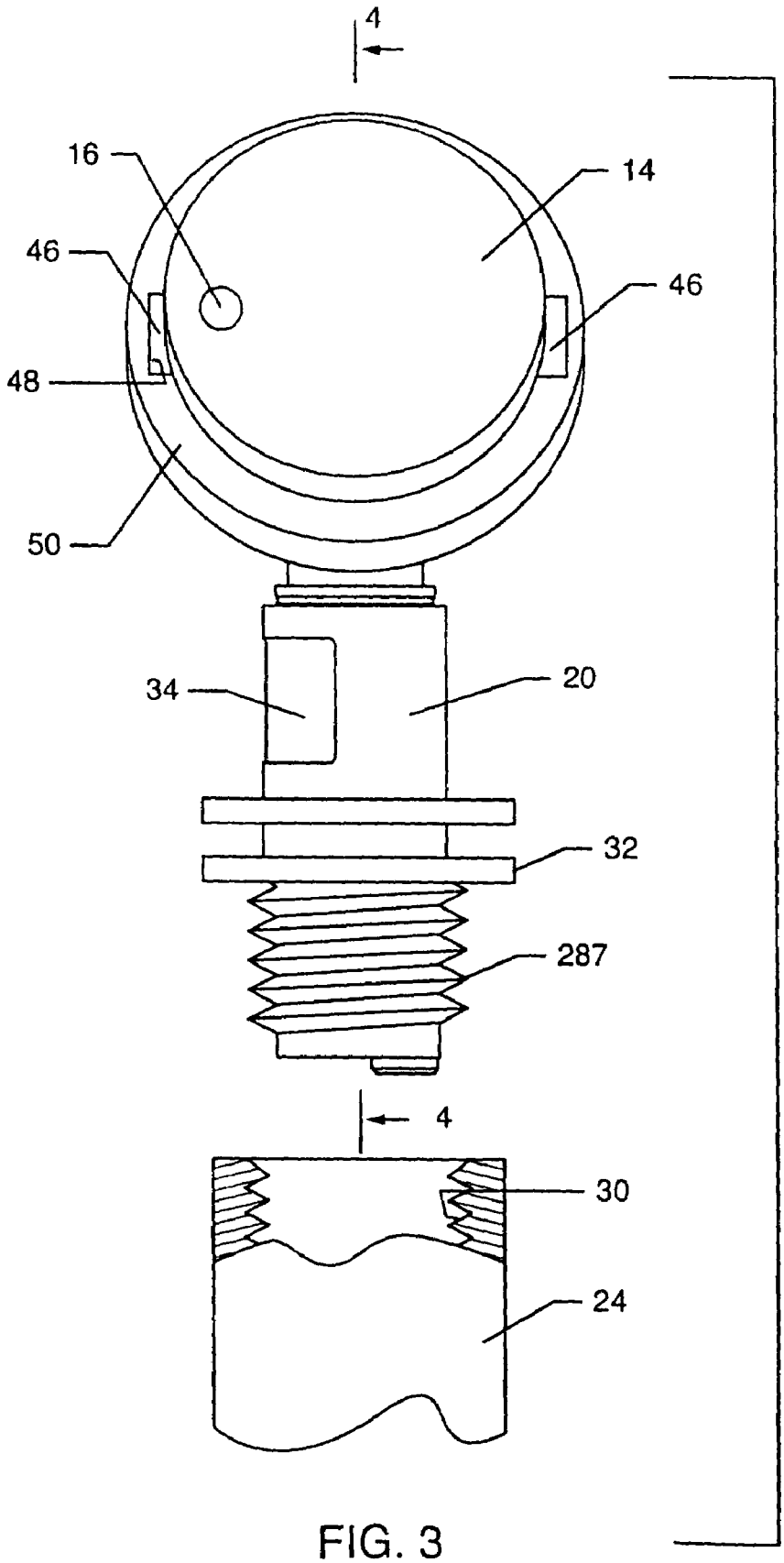
FIG. 3 is an enlarged front elevation view of the rotating stream sprinkler depicted in exploded relation with a tubular.

As shown in the exemplary drawings, a rotating stream sprinkler referred to generally in FIGS. 1-6 by the reference numeral 10 includes a rotatable spray head 12 having a nozzle member 14 with an offset nozzle port 16 formed therein for outward projection of an irrigation water stream 18 (FIGS. 1-2) to irrigate a surrounding terrain area. The spray head 12 is rotatably mounted on a sprinkler body 20 by means of a bearing assembly 22 (FIGS. 4-5) designed to provide a predetermined friction brake torque resisting spray head rotation. The outwardly projected water stream 18 produces an hydraulic reaction force, or drive torque, which exceeds and overcomes the friction brake torque and thereby rotatably drives the spray head 12 to sweep the projected water stream 18 over the adjacent terrain. In accordance with a primary aspect of the invention, the drive torque and brake torque are maintained in a balanced, substantially constant ratio for relatively slow and substantially constant spray head rotational speed over a normal operating range of water supply pressures.

The rotating stream sprinkler 10 of the present invention generally comprises the rotatable spray head 12 mounted onto the compact sprinkler base or body 20 which is in turn adapted for convenient thread-on mounting or the like onto the upper end of a stationary or pop-up tubular riser 24 (FIGS. 1 and 3-6). In general terms, the spray head 12 carries the nozzle member 14 which may be removably mounted thereon and defines the offset nozzle port 16 of selected geometry. In this regard, the nozzle port 16 has a predetermined nozzle bore size defining a predetermined open flow area, and is formed in the nozzle member 14 at a selected inclination angle. In addition, the nozzle port 16 is offset relative to a central axis of rotation 26 of the spray head 12 by a selected radial spacing increment. With this geometry, when the sprinkler 10 is connected to a supply of water under pressure, the irrigation water stream 18 projected outwardly through the offset nozzle port 16 produces an hydraulic reaction force which is radially offset relative to the rotational axis 26, resulting in applying a drive torque to the spray head 12 for rotationally driving said spray head about the rotational axis 26. The magnitude of this drive torque is proportional to the product of the water supply pressure, the nozzle flow area, and the nozzle port radial offset distance.

The bearing assembly 22 (FIGS. 4-5) rotatably supports the spray head 12 on the sprinkler body 20, for spray head rotation about the central axis 26. This bearing assembly 22 comprises a combination of interengaging friction-producing bearing components and related seal components for rotatably supporting the spray head 12 substantially without significant water leakage at this rotary interface. In general, these friction-producing bearing components provide a friction brake torque which resists or retards spray head rotation. The magnitude of this brake torque is proportional to the product of water supply pressure, the coefficient of friction between the friction-producing bearing components, and the radius of those bearing components relative to the central rotational axis 26.

In accordance with the invention, the geometry of the nozzle port 16 is appropriately tailored to provide a predetermined drive torque, whereas the friction-producing bearing components are appropriately designed to provide a predetermined brake torque so that the drive torque and brake torque are maintained at a substantially constant ratio throughout a normal operating range of water supply pressures. In this regard, by maintaining the drive/brake torque ratio substantially constant, the rotational speed of the spray head 12 is also maintained substantially constant throughout such normal range of water supply pressures. Moreover, by designing the nozzle port 16 so that the drive/brake torque ratio is relatively small, a desirably slow rotational spray head speed on the order of about 0.5 to about 5 rpm, and more preferably on the order of about 0.5 to about 2 rpm, within a water supply pressure range of about 25-100 psi is achieved. As a result, excessive spray head rotational speeds which yield an undesirably reduced range or radius of throw for the projected water stream are avoided.

With specific reference to the exemplary embodiment shown in the illustrative drawings, the sprinkler body 20 generally comprises a hollow cylindrical structure which may be conveniently formed from lightweight molded plastic or the like to include an external thread 28 (FIGS. 3-5) at a lower end thereof for thread-in connection with an internal thread 30 at an upper end of the tubular riser 24. Alternately, it will be appreciated that the external/internal threads 28, 30 of the body 20 and the riser 24 may be reversed. A stop flange 32 may be included on the sprinkler body 20 for engaging an axial upper end of the riser 24, and wrench flats 34 (FIGS. 1 and 6) may be formed in the exterior of the body 20 for convenient engagement by a wrench or other suitable tool (not shown) for installing and/or removing the sprinkler body 20 relative to the riser 24. An axially upper end of the sprinkler body 20 includes a radially inwardly extending upper wall 36 having a central aperture 38 formed therein.

The spray head 12 comprises a cap-like structure which may also be formed conveniently from lightweight molded plastic or the like. As shown, the spray head 12 includes a downwardly protruding central bearing sleeve 40 received through the central aperture 38 formed in the upper wall 36 of the sprinkler body 20. This bearing sleeve 40 defines a flow passage 42 that extends upwardly into the spray head interior, and then turns generally radially outwardly to extend through a barrel segment 44 with a diametrically enlarged cross sectional area and, if desired, a selected angle of inclination shown in the exemplary drawings to be on the order of about 12-15°. An outboard or distal end of this barrel segment 44 is adapted for removable mounting of the associated nozzle member 14, as by means of one or more undercut tabs 46 (FIGS. 1-3 and 6) for snap-fit interlocking engagement into mating tab slots 48 formed in a base collar 50 of the nozzle member 14. Alternative removable mounting means such as other snap-fit arrangements, part-turn connection, and the like will be apparent to persons skilled in the art. Importantly, the nozzle member 14 includes the nozzle port 16 formed therein at a position offset by a selected radial increment relative to the central axis 26 which corresponds to a central axis of the spray head bearing sleeve 40.

Figure 4:
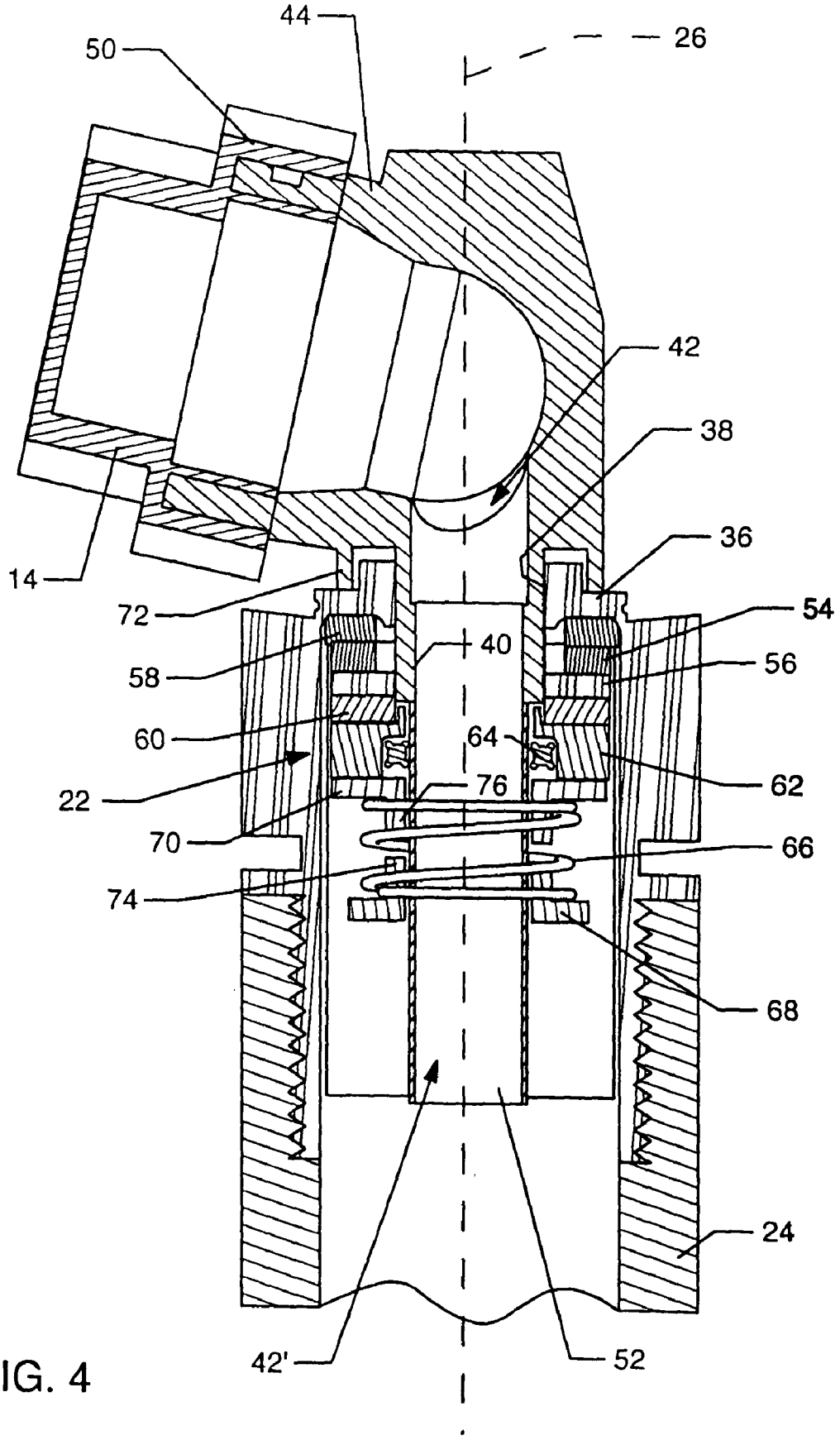
FIG. 4 is a fragmented vertical sectional view taken generally on the line 4-4 of FIG. 3, and illustrating the sprinkler in an inoperative position with a water supply turned off.
Figure 5:
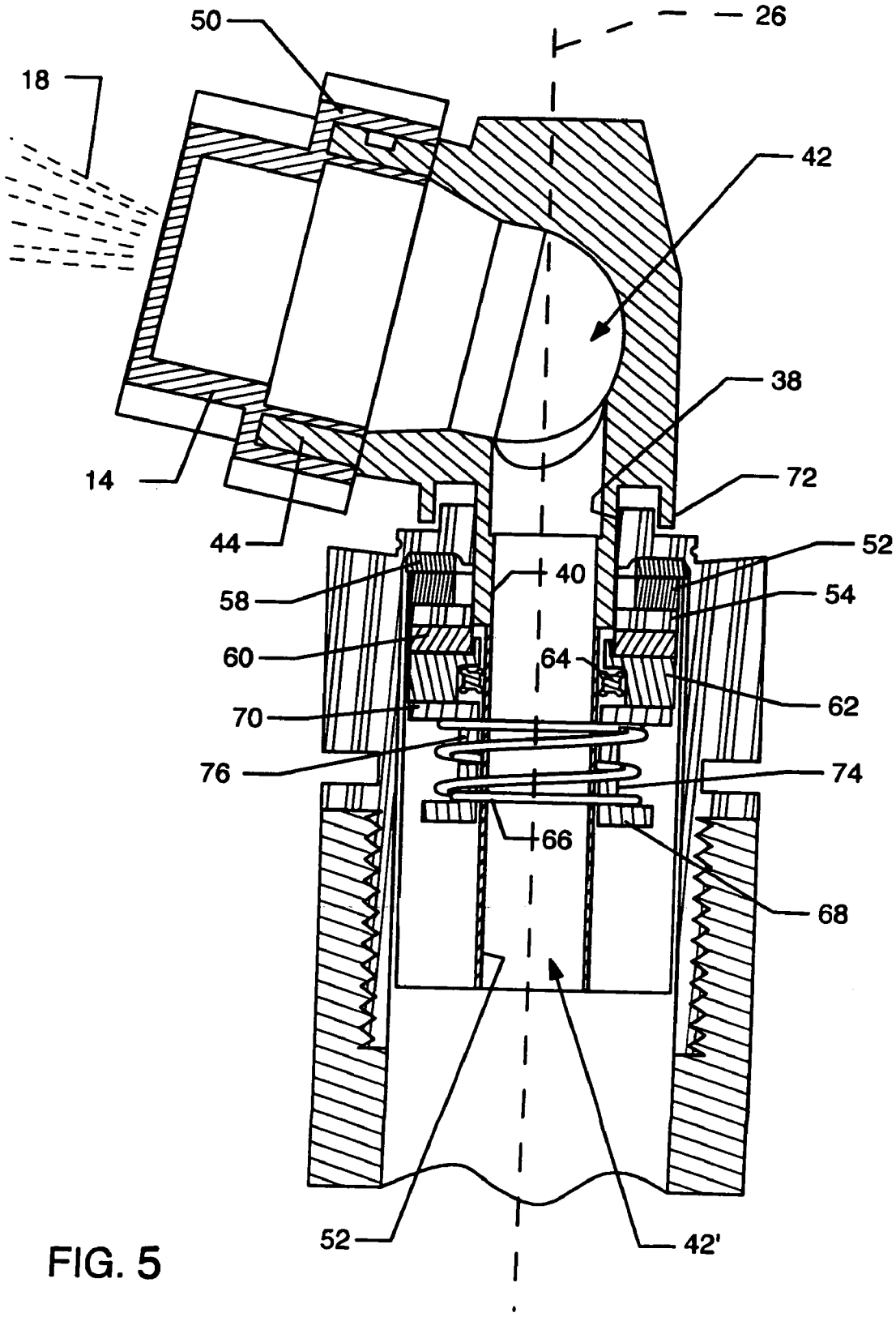

As viewed in FIGS. 4-5, the bearing sleeve 40 of the spray head 12 extends downwardly through the central aperture 38 formed in the upper wall 36 of the sprinkler body 20, into the interior of the sprinkler body 20 where it is connected coaxially to the upper end of a downwardly extending tubular nipple 52. In this regard, the upper end of the nipple 52 may be secured to the bearing sleeve 40 as by press-fit or adhesive or welded reception thereto, or said nipple may be formed as an integral extension of the bearing sleeve 40, to define a downward continuation 42' of the spray head flow passage 42. The bearing sleeve 40 and the associated nipple 52 are rotatably supported within the sprinkler body 20 by the bearing assembly 22.

More particularly, the bearing assembly 22 comprises an upper stationary friction washer 54 of annular shape and formed from a material having a selected coefficient of friction for axial bearing engagement with a lower rotatable friction washer 56 also having an annular shape and being formed from a material having a selected coefficient of friction. A first annular seal washer 58 is interposed axially between the stationary upper friction washer 54 and an inboard or underside surface of the upper wall 36 of the sprinkler body 20. Similarly, a second annular seal washer 60 is interposed axially between the rotatable lower friction washer 56 and an annular bearing thrust ring 62. This thrust ring 62 is rotatably carried with the nipple 52 and the spray head 12 connected thereto, with a O-ring seal 64 or the like preventing water leakage therebetween.

The stationary and rotatable friction washers 54, 56 are maintained in axially bearing engagement by means of a thrust spring 66. As shown, this thrust spring 66 comprises a coil spring or the like positioned about a lower region of the nipple 52, and disposed axially between a lower spring flange 68 secured to the nipple 52 and an upper spring flange 70 axially slidable on the nipple 52 and disposed in bearing engagement with an underside surface of the thrust ring 62 for applying an axial spring force to the friction washers 54, 56 and the associated seal washers 58, 60 stacked therewith.

When the sprinkler 10 is in an inoperative condition, i.e., when the riser 22 is not coupled to a supply of water under pressure, the thrust spring 66 reacts between the opposed spring flanges 68, 70 to translate the nipple 52 and the spray head 12 downwardly through a short stroke until a lower margin of a depending peripheral skirt 72 on the spray head 12 seats upon the upper wall 36 of the sprinkler body 20, as viewed in FIG. 4. In this position, the thrust spring 66 retains the bearing components including the stationary/rotatable friction washers 54, 56 and the associated seal washers 58, 60 as well as the bearing thrust ring 62 in axially bearing or axially closed relation to preclude undesired intrusion of dirt or grit between any of these interengaging components. At the same time, the thrust spring 66 retains the spray head skirt 72 in seated relation on the sprinkler body 20 to preclude ingestion of dirt or grit into the interior of the sprinkler body.

When the riser 22 is coupled to a supply of water under pressure, for normal sprinkler operation, water pressure within the sprinkler body 20 acts upon the lower spring flange 68 and the spray head 12 for translating the spray head upwardly through a short axial stroke sufficient to displace an upwardly extending stop element or sleeve 74 on the flange 68 into axially bottomed out contact with a downwardly extending stop element or sleeve 76 on the upper spring flange 70 (as viewed in FIG. 5). At the same time, while the spray head skirt 72 is elevated by this short stroke a short distance above the upper wall 36 of the body 20, the water pressure acts upon the upper spring flange 70 to retain the stack of bearing components in axially bearing or axially closed relation for continued prevention of dirt or grit intrusion between these components during sprinkler operation. Importantly, with this construction, the bearing components are retained in closed relation by water pressure, whereas the axial contact between the stop sleeves 74, 76 removes the force of the thrust spring 66 from these bearing components. In alternative configurations, the stop sleeve 74 on the lower spring flange 68 may be elongated for directly contacting the upper spring flange 70, or the stop sleeve 76 on the upper spring flange 70 may be elongated for directly contacting the lower spring flange 68, when the water supply is turned on.

The water under pressure is coupled through the nipple 52 and the spray head passage 42 to the nozzle member 16, from which the irrigation water stream 18 is projected outwardly through the offset nozzle port 16, as previously described. The projected water stream 18 produces the reaction drive torque for rotatably driving the spray head 12 about the central axis 26, to correspondingly sweep the water stream 18 over the surrounding terrain and associated vegetation. During such rotation, the upper friction washer 54 and the associated seal washer 58 remain stationary with the nonrotating sprinkler body 20, whereas the lower friction washer 56 and the remaining components of the bearing assembly 22 including the thrust spring 66 and associated spring flanges 68, 70 rotate with the nipple 52 and spray head 12.

In accordance with the invention, the friction brake torque can be regulated to a predetermined or selected magnitude by appropriate selection of the friction material or materials used for the friction washers 54, 56 and their diametric sizes and/or interengaging surface areas. In one preferred form, the friction washers are constructed from an elastomer material such as silicone rubber or a suitable synthetic elastomer such as that available under the designation Delrin 500 from E.I. Du Pont De Nemours and Company, Wilmington, Del. Similarly, the drive torque can be limited to a predetermined or selected magnitude by appropriate design of the nozzle member 14 to include the nozzle port 16 having a selected open flow area and a selected offset spacing relative to the central rotational axis 26. The inclination angle of the nozzle port 16 may also impact the magnitude of the drive torque, with a typical nozzle port inclination angle ranging from about plus 15° to about minus 15°, wherein this nozzle port inclination angle cooperates with the inclination angle of the barrel segment 44 to define the actual inclination angle of the projected water stream 18.

Figure 6:
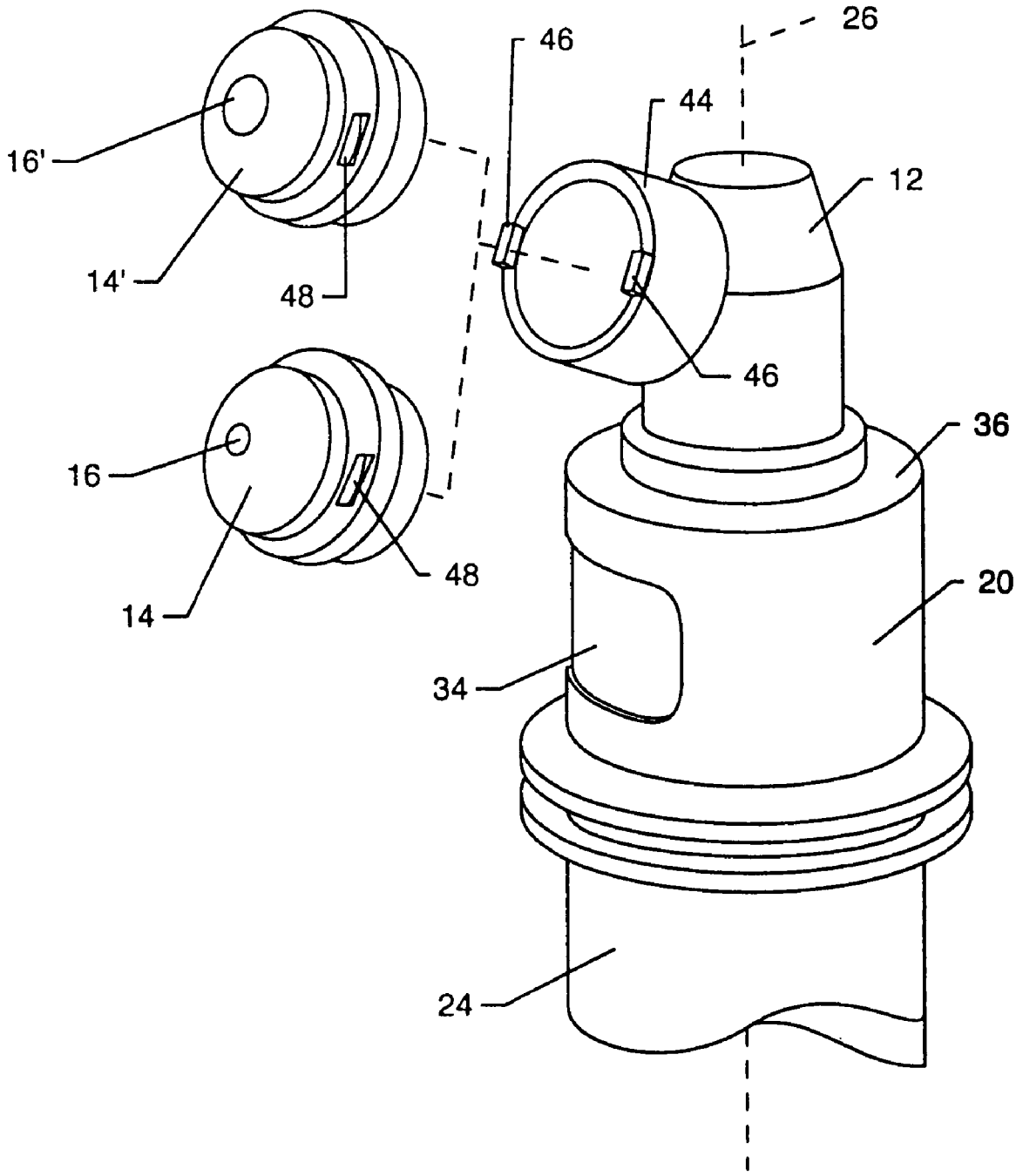
FIG. 6 is a fragmented and partially exploded perspective view of the sprinkler, similar to FIG. 1, but illustrating interchangeable mounting of alternative nozzle members onto the sprinkler.

FIG. 6 illustrates selective mounting of alternative nozzle members 14 and 14' onto the spray head 12, wherein these nozzle members 14, 14' respectively include nozzle ports 16 and 16' of different open flow area but adjusted offset spacing to provide the same drive torque at a given water supply pressure. In this regard, the reaction drive torque normally increases as a function of increased open flow area of the nozzle port 16, or increased radial offset of the nozzle port relative to the rotational axis 26. By appropriately designing a larger area nozzle port 16' (FIG. 6) to be offset by a reduced distance relative to the axis 26, the reaction drive torque obtained from any one of a group of nozzle members can be substantially uniform.

Accordingly, by appropriately designing the nozzle member selected for mounting onto the spray head 12, the projected water stream 18 may be tailored with a desired set of flow, trajectory and range characteristics, while providing a common and known drive torque for rotatably driving the spray head. As a result, since the friction brake torque is set by appropriate selection of the friction washer materials and size, the ratio of drive torque to brake torque can be maintained at a predetermined and relatively low, substantially constant value throughout a normal operating range of water supply pressures. This constant, relatively small ratio of drive torque to brake torque thereby provides for spray head rotation at a consistent, relatively slow, and substantially constant rate of speed throughout the normal water supply pressure range.

A variety of further modifications and improvements in and to the rotating stream sprinkler of the present invention will be apparent to those persons skilled in the art. Accordingly, no limitation on the invention is intended by way of the foregoing description and accompanying drawings, except as set forth in the appended claims.

What is claimed is:

1. A rotating stream sprinkler, comprising:

a sprinkler body adapted for connection to a supply of water under pressure;

a spray head rotatably mounted on said sprinkler body and having a first spring contact surface, the spray head carrying a nozzle having a nozzle port formed therein for outward projection of an irrigation water stream when said sprinkler body is connected to a supply of water under pressure, said nozzle port being offset relative to an axis of rotation of said spray head whereby the outwardly projected water stream produces a reaction drive torque for rotatably driving said spray head;

a bearing assembly rotatably supporting said spray head relative to said sprinkler body, said bearing assembly including a second spring contact surface and at least one rotatable friction washer rotatable with said spray head and disposed in friction-producing bearing engagement with at least one substantially stationary friction washer carried by said sprinkler body to produce a friction brake torque resisting spray head rotation;

said reaction drive torque and said friction brake torque being maintained in a substantially constant ratio for relatively slow and approximately constant speed rotational movement of said spray head throughout a normal operating range of water supply pressures; and a thrust spring positioned against the first spring contact surface and the second spring contact surface above the first spring contact surface, the spring expanding when the supply of water under pressure is turned off to apply a spring force for retaining said rotatable and stationary friction washers in bearing engagement and to apply a spring force for assisting in retraction of the spray head for seating the spray head with the sprinkler body.

2. The rotating stream sprinkler of claim 1 wherein said spray head further including a peripheral skirt for seated engagement upon said sprinkler body when the supply of water under pressure is disconnected from said sprinkler body.

3. The rotating stream sprinkler of claim 1 wherein said thrust spring reacts between a first spring flange secured to a nipple carried by said spray head, and a second spring flange axially slidable on said nipple for applying an axial spring force to said friction washers.

4. A rotating stream sprinkler, comprising:

a sprinkler body adapted for connection to a supply of water under pressure;

a spray head rotatably mounted on said sprinkler body and carrying a nozzle having a nozzle port formed therein for outward projection of an irrigation water stream when said sprinkler body is connected to a supply of water under pressure, said nozzle port being offset relative to an axis of rotation of said spray head whereby the outwardly projected water stream produces a reaction drive torque for rotatably driving said spray head;

a bearing assembly rotatably supporting said spray head relative to said sprinkler body, said bearing assembly including at least one rotatable friction washer rotatable with said spray head and disposed in friction-producing bearing engagement with at least one substantially stationary friction washer carried by said sprinkler body to produce a friction brake torque resisting spray head rotation, said reaction drive torque and said friction brake torque being maintained in a substantially constant ratio for relatively slow and approximately constant speed rotational movement of said spray head throughout a normal operating range of water supply pressures;

a thrust spring for applying a spring force for retaining said rotatable and stationary friction washers in bearing engagement when the supply of water under pressure is disconnected from said sprinkler body, wherein said thrust spring reacts between a first spring flange secured to a nipple carried by said spray head and a second spring flange axially slidable on said nipple for applying an axial spring force to said friction washers and, further including a stop element on said first spring flange for abutting contact with a stop element on said second spring flange in response to connection of said sprinkler body to the supply of water under pressure, whereby the spring force is removed from said friction washers and said friction washers are retained in bearing engagement by water pressure.

5. A rotating stream sprinkler, comprising:

a sprinkler body adapted for connection to a supply of water under pressure;

a spray head rotatably mounted on said sprinkler body and carrying a nozzle having a nozzle port formed therein for outward projection of an irrigation water stream when said sprinkler body is connected to a supply of water under pressure, said nozzle port being offset relative to an axis of rotation of said spray head whereby the outwardly projected water stream produces a reaction drive torque for rotatably driving said spray head;

a bearing assembly rotatably supporting said spray head relative to said sprinkler body, said bearing assembly including at least one rotatable friction washer rotatable with said spray head and disposed in friction-producing bearing engagement with at least one substantially stationary friction washer carried by said sprinkler body to produce a friction brake torque resisting spray head rotation, said reaction drive torque and said friction brake torque being maintained in a substantially constant ratio for relatively slow and approximately constant speed rotational movement of said spray head throughout a normal operating range of water supply pressures;

a thrust spring for applying a spring force for retaining said rotatable and stationary friction washers in bearing engagement when the supply of water under pressure is disconnected from said sprinkler body, wherein said thrust spring reacts between a first spring flange secured to a nipple carried by said spray head and a second spring flange axially slidable on said nipple for applying an axial spring force to said friction washers and, further including a stop element on at least one of said first and second spring flanges for abutting contact with the other of said first and second spring flanges in response to connection of said sprinkler body to the supply of water under pressure, whereby the spring force is removed from said friction washers and said friction washers are retained in bearing engagement by water pressure.

6. A rotating stream sprinkler, comprising:

a sprinkler body adapted for connection to a supply of water under pressure;

a spray head rotatably mounted on said sprinkler body and having a first spring contact surface, the spray head carrying a nozzle having a nozzle port formed therein for outward projection of an irrigation water stream when said sprinkler body is connected to a supply of water under pressure, said nozzle port having a selected open flow area and being offset relative to an axis of rotation of said spray head by a selected offset increment whereby the outwardly projected water stream produces a reaction drive torque of predetermined magnitude for rotatably driving said spray head;

a bearing assembly rotatably supporting said spray head relative to said sprinkler body, said bearing assembly including a second spring contact surface and at least one rotatable friction washer rotatable with said spray head and disposed in friction-producing bearing engagement with at least one substantially stationary friction washer carried by said sprinkler body, said rotatable and stationary friction washers being formed from selected friction material and having selected diametric sizes to produce a predetermined friction brake torque resisting spray head rotation;

said reaction drive torque and said friction brake torque being maintained in a substantially constant ratio for relatively slow and approximately constant speed rotational movement of said spray head throughout a normal operating range of water supply pressures; and a thrust spring positioned against the first spring contact surface and the second spring contact surface above the first spring contact surface, the spring expanding when the supply of water under pressure is turned off to apply a spring force for retaining said rotatable and stationary friction washers in bearing engagement and to apply a spring force for assisting in retraction of the spray head for seating the spray head with the sprinkler body.

7. The rotating stream sprinkler of claim 6 wherein said spray head further including a peripheral skirt for seated engagement upon said sprinkler body when the supply of water under pressure is disconnected from said sprinkler body.

8. The rotating stream sprinkler of claim 6 wherein said thrust spring reacts between a first spring flange secured to a nipple carried by said spray head, and a second spring flange axially slidable on said nipple for applying an axial spring force to said friction washers.

9. A rotating stream sprinkler, comprising:

a sprinkler body adapted for connection to a supply of water under pressure;

a spray head rotatably mounted on said sprinkler body and carrying a nozzle having a nozzle port formed therein for outward projection of an irrigation water stream when said sprinkler body is connected to a supply of water under pressure, said nozzle port having a selected open flow area and being offset relative to an axis of rotation of said spray head by a selected offset increment whereby the outwardly projected water stream produces a reaction drive torque of predetermined magnitude for rotatably driving said spray head;

a bearing assembly rotatably supporting said spray head relative to said sprinkler body, said bearing assembly including at least one rotatable friction washer rotatable with said spray head and disposed in friction-producing bearing engagement with at least one substantially stationary friction washer carried by said sprinkler body, said rotatable and stationary friction washers being formed from selected friction material and having selected diametric sizes to produce a predetermined friction brake torque resisting spray head rotation, said reaction drive torque and said friction brake torque being maintained in a substantially constant ratio for relatively slow and approximately constant speed rotational movement of said spray head throughout a normal operating range of water supply pressures;

a thrust spring for applying a spring force for retaining said rotatable and stationary friction washers in bearing engagement when the supply of water under pressure is disconnected from said sprinkler body, wherein said thrust spring reacts between a first spring flange secured to a nipple carried by said spray head, and a second spring flange axially slidable on said nipple for applying an axial spring force to said friction washers, further including a stop element on at least one of said first and second spring flanges for abutting contact with the other of said first and second spring flanges in response to connection of said sprinkler body to the supply of water under pressure, whereby the spring force is removed from said friction washers and said friction washers are retained in bearing engagement by water pressure.

10. A rotating stream sprinkler, comprising:

a sprinkler body adapted for connection to a supply of water under pressure;

a spray head rotatably mounted on said sprinkler body and carrying a nozzle having a nozzle port formed therein for outward projection of an irrigation water stream when said sprinkler body is connected to a supply of water under pressure, said nozzle port having a selected open flow area and being offset relative to an axis of rotation of said spray head by a selected offset increment whereby the outwardly projected water stream produces a reaction drive torque of predetermined magnitude for rotatably driving said spray head;

a bearing assembly rotatably supporting said spray head relative to said sprinkler body, said bearing assembly including at least one rotatable friction washer rotatable with said spray head and disposed in friction-producing bearing engagement with at least one substantially stationary friction washer carried by said sprinkler body, said rotatable and stationary friction washers being formed from selected friction material and having selected diametric sizes to produce a predetermined friction brake torque resisting spray head rotation; and a thrust spring having a compressed form under operation of the sprinkler and an expanded form, the spring expanding to the expanded form when the supply of water under pressure is turned off to apply a spring force for retaining said rotatable and stationary friction washers in bearing engagement and to apply a spring force for assisting in retraction of the spray head for seating the spray head with the sprinkler body.

11. The rotating stream sprinkler of claim 10 wherein said spray head nozzle comprises a selected one of a plurality of nozzle members removably and interchangeably mounted on said spray head, each of said nozzle members having an offset nozzle port formed therein of selected open flow area and selected offset increment spacing relative to the axis of spray head rotation whereby the outwardly projected water stream associated with said nozzle members provides a substantially common reaction drive force of predetermined magnitude for rotatably driving said spray head.

12. The rotating stream sprinkler of claim 10 wherein said spray head further including a peripheral skirt for seated engagement upon said sprinkler body when the supply of water under pressure is disconnected from said sprinkler body.

13. The rotating stream sprinkler of claim 10 wherein said thrust spring reacts between a first spring flange secured to a nipple carried by said spray head, and a second spring flange axially slidable on said nipple for applying an axial spring force to said friction washers.

14. A rotating stream sprinkler, comprising:

a sprinkler body adapted for connection to a supply of water under pressure;

a spray head rotatably mounted on said sprinkler body and carrying a nozzle having a nozzle port formed therein for outward projection of an irrigation water stream when said sprinkler body is connected to a supply of water under pressure, said nozzle port having a selected open flow area and being offset relative to an axis of rotation of said spray head by a selected offset increment whereby the outwardly projected water stream produces a reaction drive torque of predetermined magnitude for rotatably driving said spray head;

a bearing assembly rotatably supporting said spray head relative to said sprinkler body, said bearing assembly including at least one rotatable friction washer rotatable with said spray head and disposed in friction-producing bearing engagement with at least one substantially stationary friction washer carried by said sprinkler body, said rotatable and stationary friction washers being formed from selected friction material and having selected diametric sizes to produce a predetermined friction brake torque resisting spray head rotation;

a thrust spring for applying a spring force for retaining said rotatable and stationary friction washers in bearing engagement when the supply of water under pressure is disconnected from said sprinkler body, wherein said thrust spring reacts between a first spring flange secured to a nipple carried by said spray head and a second spring flange axially slidable on said nipple for applying an axial spring force to said friction washers; and a stop element on at least one of said first and second spring flanges for abutting contact with the other of said first and second spring flanges in response to connection of said sprinkler body to the supply of water under pressure, whereby the spring force is removed from said friction washers and said friction washers are retained in bearing engagement by water pressure.

* * * * *